United States Patent [19]

Wiener et al.

[11] Patent Number: 4,590,786

[45] Date of Patent: May 27, 1986

[54] CABLE SHOE TONGS WITH A STOP MEANS

[75] Inventors: Hans Wiener, Täby; Hans Undin, Åkersberga, both of Sweden

[73] Assignee: C. A. Weidmüller GmbH & Co., Detmold, Fed. Rep. of Germany

[21] Appl. No.: 599,236

[22] Filed: Apr. 11, 1984

[30] Foreign Application Priority Data

Apr. 19, 1983 [SE] Sweden ..... 8302186

[51] Int. Cl.[4] ..... B21D 7/06; B21D 53/36

[52] U.S. Cl. ..... 72/410; 29/751; 72/461; 81/421; 81/420

[58] Field of Search ..... 72/410, 409, 461; 29/751; 81/418, 420, 421, 424

[56] References Cited

U.S. PATENT DOCUMENTS

| | | | |
|---|---|---|---|
| 2,440,040 | 4/1948 | Burton | 72/410 |
| 2,765,688 | 10/1956 | Evans | 72/409 |
| 3,039,337 | 6/1962 | Stuart-Prince | 72/410 |
| 3,523,351 | 8/1970 | Filia | 72/410 |
| 4,048,877 | 9/1977 | Undin | 72/410 |

FOREIGN PATENT DOCUMENTS

| | | | |
|---|---|---|---|
| 463670 | 3/1950 | Canada | 81/376 |
| 1522144 | 8/1978 | United Kingdom | 72/410 |

*Primary Examiner*—Daniel C. Crane

*Attorney, Agent, or Firm*—Toren, McGeady, Stanger, Goldberg & Kiel

[57] ABSTRACT

A pair of tongs is on one side of the tool body provided with a rocker arms defining a two-armed lever. The forward arm portion of the rocker arms lies as a stop before die members provided in one of the jaws, and has an abutment edge over which the contact portion but not the affixing portion of a cable shoe inserted into the pair of tongs can pass. The rocker arm, affected by a spring, is with the aid of two actuating elements operated in such a way that in the final phase of a crimping operation the forward arm portion is totally removed from the area of the die members, thus enabling an elongation of the affixing portion of the respective cable shoe when being crimped.

17 Claims, 6 Drawing Figures

CABLE SHOE TONGS WITH A STOP MEANS

BACKGROUND OF THE INVENTION

The invention refers to a pair of pliers or tongs for crimping onto electrical conductors cable shoes which have a contact portion and an affixing or crimping portion open toward the contact portion. The contact portion of a cable shoe serves for establishing electrical contact with some other electrical contact member, and the affixing portion serves for establishing electrical and mechanical connection with the end portion of an electrical conductor on which the cable shoe is slipped on. The contact portion may have a widely varying shape, but the affixing portion has always substantially the shape of a tube or barrel into which said end portion of a conductor, with at least partially stripped-off insulation, can be inserted. The cable shoe is affixed to the conductor by crimping of the affixing portion.

Crimping pliers or tongs for cable shoes have conventionally a pair of reciprocating jaws operable by a pair of handles and carrying a plurality of crimping die members or elements. A first jaw and a first handle may be joined to define an elongated, rigid tool body to which the second jaw is pivoted. The second jaw may have beyond its pivot point a rear extension where it is pivotally connected with the second handle. A stop or locator and retainer means for an inserted cable shoe can be mounted along one side face of one jaw adjacent one or more die members.

A cable shoe, when correctly inserted into the tool, strikes or abuts, e.g. by the end of the crimping portion adjacent the contact portion, with said means. Such a solution has however the disadvantage of not taking into account the lengthening of the crimping portion which occurs upon crimping, especially when the crimping portion is covered by a sleeve of insulating plastics.

SUMMARY OF THE INVENTION

It is an object of the present invention to provide a pair of crimping pliers or tongs for cable shoes having a locator and retainer means of a kind which takes into account the lengthening of the affixing portion of the cable shoe occuring upon crimping. It is another object of the invention to provide such a means which holds fast the inserted cable shoe already before the crimping operation proper begins.

BRIEF DESCRIPTION OF THE DRAWINGS

The invention will now be described more in detail with the aid of the enclosed drawings, in which.

Like reference numerals designate functionally corresponding parts throughout the several figures of the drawings.

DETAILED DESCRIPTION OF THE INVENTION

Figure 1A:
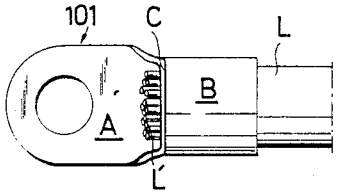
FIGS. 1*a* and 1*b* show on an enlarged scale two different embodiments of known cable shoes which may be treated in tongs according to the present invention.
Figure 1B:
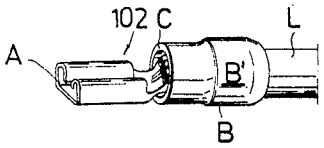
PRIOR ART Fig. 1b

According to FIGS. 1*a* and 1*b*, cable shoes 101 or 102 have a contact portion A and an affixing or crimping portion B into which an electrical conductor L can be introduced from the right hand side in the drawing, and be retained therein by crimping. The crimping portion B is open also at the left hand side in the drawing, i.e. towards the contact portion A, and is there terminated by an end edge C. The crimping portion B of the cable shoe 102 of FIG. 1*b* is provided with a plastics sleeve B' which gets still more elongated upon crimping than the metal part which it covers. Cable shoes of this kind are known.

Figure 2:
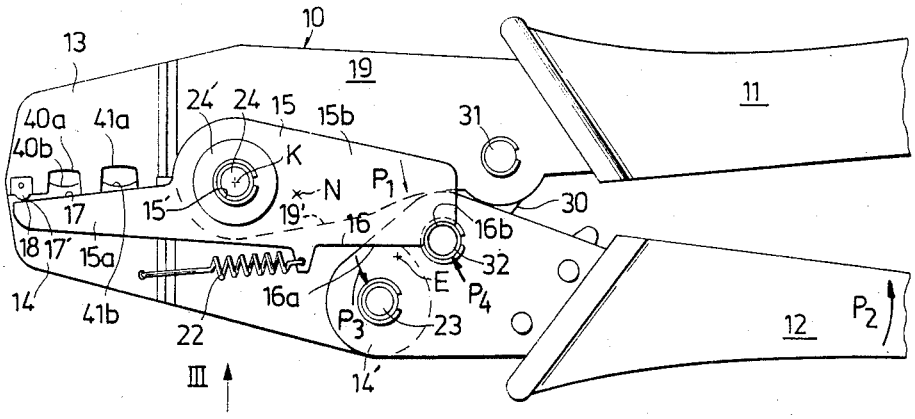
PRIOR ART Fig. 2
FIG. 2 is a lateral view of the forward part of a first embodiment of the device according to the present invention in closed position.
Figure 3:
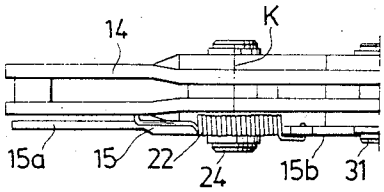
FIG. 3 is a plan view of the most forward portion of the device of FIG. 2 seen in the sense of arrow III in FIG. 2.
Figure 4:
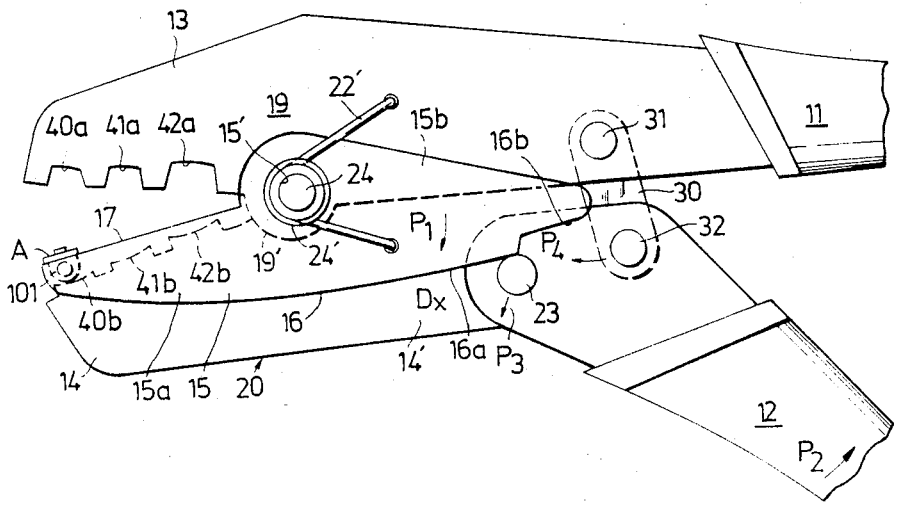
FIG. 4 is a lateral view of the forward part of a second embodiment of the device according to the present invention in open position.

According to FIGS. 2 to 4, a pair of cable shoe tongs 10 or 20 of known construction have a first jaw 13, and a second jaw 14 which are operated by two handles 11, 12. The first jaw 13 and a first handle 11 are united to an elongated, rigid tool body 19 which has an inner peripheric edge 19'. The second jaw 14 is attached to the first jaw 13 and to the body 19 with the aid of a first pivot pin 24, so that it may pivot about an axis K, which is the pivot axis of the pair of jaws. The second handle 12 is by means of a second pivot pin 23 attached to the second jaw 14, more correctly to a rear extension 14' thereof, and with the aid of a third pivot pin 32 to one end of a connecting link 30. Connecting link 30 is at the other end by a pivot pin 31 pivotally attached to the tool body 19.

As already stated, the second pivot pin 23 is located on a rear extension 14' of the jaw 14 extending beyond the axis K and the first pin 24. The second pin 23 has thus an unvariable position in regard of the second handle 12 as well as in regard of the second jaw 14 and travels, when the second handle 12 is actuated, along a circular path having its center in the first pivot pin 24. A spring means, not shown, holds the pair of jaws and the pair of handles in an open position.

In the first jaw 13 there is at least one and, in the example illustrated there are three crimping die members or elements such as 40*a*, 41*a* and 42*a* provided, and in the second jaw 14 are co-operating crimping die members or elements 40*b*, 41*b*, 42*b* arranged. A tongs construction of this kind is known, lies beyond the scope of the present invention. A pair of pliers of this kind is described more in detail e.g. in the German Offenlegungsschrift OS No. 2,555,071 (published in print).

According to the present invention, a locator and retainer means 15 is pivotally attached to the outer side face of the tool body 19 and is embodied by a flat rocker bracket which defines a two-armed lever extending parallel with the tool body in the length direction thereof. The forward arm portion 15*a* of the rocker bracket 15 extends from the fulcrum or pivot point of the rocker arm defined by the first pivot pin 24 forwardly towards the forward ends of the jaws 13, 14, and the rear arm portion 15*b* extends rearwardly from said fulcrum point toward the handles 11, 12. The rocker bracket 15 is in its mid-length region provided with an opening 15' through which the first pivot pin 24, which also connects the jaws 13 and 14 at their rear ends, one with another, passes and which carries a washer 24'. However, the rocker bracket 15 may also be pivoted to the tool body 19 at some other place in the region of the axis K, i.e. on a pivot pin of its own, e.g. at the location N (FIG. 2).

The forward arm portion 15*a* of the rocker bracket 15 is provided with an abutment edge 17 turned toward the die elements 40*a* etc. in the first jaw 13, and the rear arm portion 15*b* is provided on the opposite side, i.e. on the side which is turned toward the second handle 12 and away from the tool body 19 with a limiting engagement edge 16 which in the embodiment of FIG. 2 has two zones 16*a*, 16*b*, of which zone 16*b* is graded or offset in respect of the zone 16*a*. A first actuating means, in the example shown defined by the above mentioned second pivot pin 23, which for the purpose is made with a projecting portion, is arranged for engagement with the zone 16*a* in the open position of the jaws 13, 14 (as seen in FIG. 4) and a second actuating means, in the example shown defined by the third pivot pin 32, which for the purpose is also made somewhat projecting, is provided for engagement with the zone 16*b* in the closed position of the jaws 13, 14 (as seen in FIG. 2). Instead of said pivot pins 23, 32 also separate actuating means may be provided to the purpose, e.g. engagement pins at the locations D (FIG. 4) and/or E (FIG. 2), zone 16*b* being then possibly extended a bit forward.

A helical extension spring 22 (FIG. 2) or a spring 22' having two projecting legs and a loop slipped on the first pivot pin 24 and retained there by said washer 24' is provided to constantly affect the rocker arm 15 so as to press it in the sense of arrow $P_1$ against one or the other of the two actuating means. It is to be noted that the spring 22 or spring 22 or 22' is different from the earlier mentioned conventional spring means, not shown, which are used to hold the pair of jaws 13, 14 in open position.

The device operates as follows. A cable shoe such as 101 is inserted into an open pair of tongs from the reverse side than where the rocker bracket 15 is mounted, i.e. from above in FIG. 3, by being accomodated in a selected crimping die element in the second jaw 14 and pushed so far until the end edge C of the cable shoe's affixing portion B abuts against the forward arm portion 15*a*, of the rocker bracket 15, the flat contact portion A projecting above and beyond the abutment edge 17 (see FIG. 4). Such initial position is readily obtained by convenient mutual positioning of the opening 15' and the abutment edge 17. The stripped end portion of a conductor L is inserted into the affixing portion B until it also abuts with the forward arm portion 15*a*. The forward arm portion 15*a* of the rocker bracket 15 serves consequently as a locator means as well for the cable shoe, as for the conductor. Thus, the stripped end portion L' of the conductor L can never project from the affixing portion B of the cable shoe as illustrated in FIG. 1*a*.

A crimping operation is thereupon performed in conventional manner by approaching the second handle 12 in the sense of arrow $P_2$ to the first handle 11, whereby the second pivot pin 23, defining the first actuating means, is moved in the sense of arrow $P_3$ into the position shown in FIG. 2. Thereby, the zone 16*a* of the engagement edge 16 is relieved, from the first actuating means and the rocker bracket 15 is by action of the spring 22 or 22' swivelled in the sense of arrow $P_1$. The abutment edge 17 affects the contact portion A projecting thereover, whereby the affixing portion B of the respective cable shoe is pressed against the die element in the opposite first jaw 13, which in the meantime has been approached, but which normally would not yet grasp the cable shoe. Thus the position of the cable shoe in the pair of jaws 13, 14 is stabilized when these jaws begin to execute a closing movement, already before such a stabilization occurs by the the die elements in both jaws coming into contact with the cable shoe.

When the second handle 12 is swung in the sense of arrow $P_2$, the third pivot pin 32, defining the second actuating means, is moved in the sense of arrow $P_4$ towards the zone 16*b* of the engagement edge 16, because the connecting link 30 performs a circular motion centered on the pin 31. When the second actuating means, i.e. the third pivot pin 32, strikes the edge zone 16*b* (FIG. 2), the rocker bracket 15 is swivelled against the sense of arrow $P_1$, overcoming the force of the spring 22 and the abutment edge 17 totally clears the area of the die members 40*a*, 40*b* etc. Any stop or abutment means having thus been withdrawn from the operational area of the die members, the affixing portion B, and possibly also the inserted conductor may get axially elongated to any extent. When the crimping operation is terminated, the pair of tongs is again opened, both actuating means move against the sense of the arrows $P_3$ and $P_4$ respectively, and the initial position shown in FIG. 4 is re-established.

It will have been recognised that the first actuating means 23 which is fixedly attached to the rear extension 14' of the second jaw shares the pivotal movement of this jaw. Said actuating means can therefore also be situated at some other location, such as D, on the rear extension 14'.

The second actuating means which, in the example shown, performs a circular motion centered in the pin 31 against the sense of the circular motion performed by the first actuating means, can also be located on some other place, such as E, on the second handle 12 between the pivot pins 23 and 32. It will be understood from the drawing that in this case the engagement edge 16 can be made smooth, i.e. without a step. The second actuating means which has the function of swinging, during the final phase of a crimping operation, the forward arm portion 15*a* of the rocker bracket 15 away from the area of the die elements 40*a*, 40*b* etc., can also be embodied by a projection 18 (FIG. 5) of predetermined length arranged on the first jaw 13. When the jaws 13, 14 reach a predetermined closed position, the projection 18 engages the forward arm portion 15*a* of the rocker bracket 15, preferably at a forward area 17' of the abutment edge 17.

The second actuating means defines always a means which in the last phase of a crimping operation swings the rocker bracket 15 in opposite sense than in which the rocker bracket 15 was swung in the initial phase of the crimping operation (due to the action of the first actuating means and of the spring 22 or 22').

Figure 5:
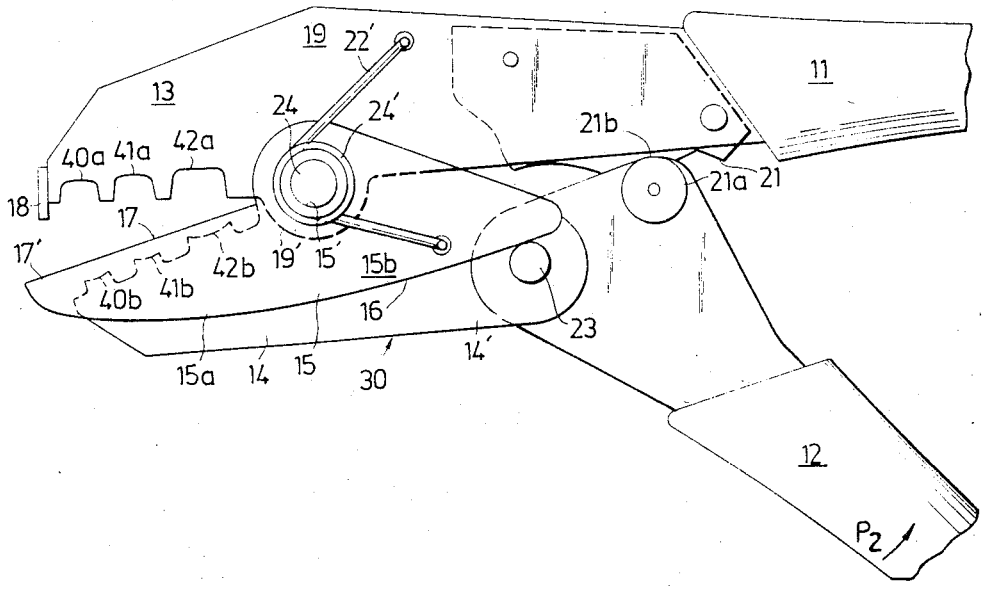
FIG. 5 is a lateral view of a third embodiment of the device according to the present invention in open position.

The invention is not limited to pairs of tongs in which the second handle 12 is attached to the tool body 19 with the aid of a connecting link. In FIG. 5 is shown a pair of cable shoe tongs according to the U.S. Pat. No. 4,048,877 and which is provided with a locator and retainer device according to the present invention. In the tool body 19 is mounted a cam member 21 and on the handle 12 is at the location 21*b* provided a cam follower member 21*a*. This construction, which lies outside the scope of the present invention, is described more in detail in the said U.S. patent. The rocker bracket 15, or, more correctly, its foward arm portion 15*a*, is forwardly somewhat lengthened so that the second actuating means can be located right at the front face of the first jaw 13.

The engagement edge 16 serves only for the engagement of the first actuating means, defined by the second pivot pin 23, and is therefore not divided into two parts.

Section 16*a* of the engagement edge 16 in the embodiment of FIGS. 2 to 4, and the whole engagement edge 16 in the embodiment of FIG. 5, define an engagement means for the first actuating means. The section 16*b* of the engagement edge 16 in the embodiments of FIGS. 2 to 4, and the section 17′ of the abutment edge 17 in the embodiment of FIG. 5 define an engagement means for the second actuating means.

The forward arm portion 15*a* may also be made shorter than what is shown in the drawings, e.g. so short that it is associated only with the die element or die elements lying closest to the first pivot pin 24.

What is claimed is:

1. A pair of tongs for crimping cable shoes which have a contact portion and an affixing portion open towards the contact portion, the pair of tongs comprising a pair of handles; a pair of jaws provided with a plurality of die elements and operable by said handles, a first handle united with a first jaw into a rigid, elongated tool body to which the second jaw is operably pivoted in a pivot point, said second jaw having a rear extension extending beyond said pivot point and to which extension the second handle is pivotally attached; a stop means adjacent at least one die element for securing the position of a cable shoe placed in the pair of tongs, wherein said stop means is an elongated rocker bracket extending in the longitudinal direction of the tool body. parallel therewith and defining a two-armed lever pivoted in the region of said pivot point to one side face of the tool body and having a forward arm portion extending from the place of pivotal attachment towards the front end of the pair of jaws and comprising an abutment edge adjacent said at least one die element in one jaw, and a rear arm portion extending from the place of pivotal attachment toward the handles and being provided with an engagement means for a first actuating means arranged on said extension; a second actuating means for engagement, in the last phase of a crimping operation, with an engagement means on the rocker bracket; the forward arm portion, upon engagement of the first actuating means with its associated engagement means, positioned close to at least one die element so as to define said stop means for the affixing portion of a cable shoe inserted in the respective die element and allowing the contact portion of the cable shoe to pass therebeyond, and said forward arm portion swinging away from the region of the die elements upon engagement of the second actuating means with an associated engagement means; and a spring means constantly urging the rocker bracket into engagement with one actuating means, wherein the first actuating means is defined by a projecting portion of a pin by which the pivoted jaw is connected to the second handle.

2. A pair of tongs for crimping cable shoes which have a contact portion and an affixing portion open towards the contact portion, the pair of tongs comprising a pair of handles; a pair of jaws provided with a plurality of die elements and operable by said handles, a first handle united with a first jaw into a rigid, elongated tool body to which the second jaw is operably pivoted in a pivot point, said second jaw having a rear extension extending beyond said pivot point and to which extension the second handle is pivotally attached; a stop means adjacent at least one die element for securing the position of a cable shoe placed in the pair of tongs, wherein said stop means is an elongated rocker bracket extending in the longitudinal direction of the tool body parallel therewith and defining a two-armed lever pivoted in the region of said pivot point to one side face of the tool body and having a forward arm portion extending from the place of pivotal attachment towards the front end of the pair of jaws and comprising an abutment edge adjacent said at least one die element in one jaw, and a rear arm portion extending from the place of pivotal attachment toward the handles and being provided with an engagement means for a first actuating means arranged on said extension; a second actuating means for engagement, in the last phase of a crimping operation, with an engagement means on the rocker bracket; the forward arm portion, upon engagement of the first actuating means with its associated engagement means, positioned close to at least one die element so as to define said stop means for the affixing portion of a cable shoe inserted in the respective die element and allowing the contact portion of the cable shoe to pass therebeyond, and said forward arm portion swinging away from the region of the die elements upon engagement of the second actuating means with an associated engagement means; and a spring means constantly urging the rocker bracket into engagement with one actuating means, wherein the pivoted handle is attached to the tool body with the aid of a connecting link, and the second actuating means is defined by a projecting portion of a pin by which said handle is pivotally attached to one end of the line.

3. A pair of tongs for crimping cable shoes which have a contact portion and an affixing portion open towards the contact portion, the pair of tongs comprising a pair of handles; a pair of jaws provided with a plurality of die elements and operable by said handles, a first handle united with a first jaw into a rigid, elongated tool body to which the second jaw is operably pivoted in a pivot point, said second jaw having a rear extension extending beyond said pivot point and to which extension the second handle is pivotally attached; a stop means adjacent at least one die element for securing the position of a cable shoe placed in the pair of tongs, wherein said stop means is an elongated rocker bracket extending in the longitudinal direction of the tool body parallel therewith and defining a two-armed lever pivoted in the region of said pivot point to one side face of the tool body and having a forward arm portion extending from the place of pivotal attachment towards the front end of the pair of jaws and comprising an abutment edge adjacent said at least one die element in one jaw, and a rear arm portion extending from the place of pivotal attachment toward the handles and being provided with an engagement means for a first actuating means arranged on said extension; a second actuating means for engagement, in the last phase of a crimping operation, with an engagement means on the rocker bracket; the forward arm portion, upon engagement of the first actuating means with its associated engagement means, positioned close to at least one die element so as to define said stop means for the affixing portion of a cable shoe inserted in the respective die element and allowing the contact portion of the cable shoe to pass therebeyond, and said forward arm portion swinging away from the region of the die elements upon engagement of the second actuating means with an associated engagement means; and a spring means constantly urging the rocker bracket into engagement with one actuating means, wherein the spring means is defined by a spring having two arms and slipped on the pivot pin of the pivotally attached jaw, one of the spring arms being anchored in the tool body, and the other one in the rocker bracket.

4. The pair of tongs of claims 1, 2 or 3, wherein said abutment edge presses during a closing movement of the jaws the cable shoe inserted into the tool against the die element in the jaw defining the tool body before such compression occurs by action of the associated die element in the other jaw.

5. The pair of tongs of claims 1, 2 or 3, wherein the rocker bracket is pivoted to the tool body with the aid of a pin by which the second jaw is pivoted to the tool body.

6. The pair of tongs of claims 1, 2 or 3, wherein the engagement means of the first actuating means is defined by an engagement edge on the rear arm portion of the rocker bracket.

7. The pair of tongs of claim 6, wherein the engagement means for the second actuating means is defined by a stepped-off portion of the engagement edge.

8. A pair of pliers for crimping onto electrical conductors cable shoes having a contact portion and an affixing portion which is open toward the contact portion, comprising in combination:

a first jaw and a second jaw, said jaws having respective front ends and rear ends and carrying at least one pair of co-operating crimping die elements;

a first pivot pin pivotally connecting said jaws with one another at their rear ends;

a first handle rigidly attached to said first jaw and defining therewith an elongated tool body;

a rear extension on said second jaw extending beyond said first pivot pin;

a second handle pivotally attached to said extension and operably mounted to said tool body;

a second pivot pin on said rear extension for said pivotal attachment of the second handle;

a locator and retainer means for a treated cable shoe, said means being defined by an elongated two-armed rocker bracket which at a pivot point located in a mid-length region is in parallel relationship pivotally attached to said tool body and which with a forward arm portion extends forwardly of said pivot point toward said front ends and with a rear arm portion, rigidly connected to the forward arm portion, extends rearwardly of said pivot point toward said rear extension;

a limiting edge of said forward arm portion turned toward said second jaw and defining an abutment edge for the affixing portion of a treated cable shoe and for an electrical conductor inserted into said affixing portion;

a limiting edge of said rear arm portion turned away from said tool body and defining an engagement edge for a first actuating means;

a pivot means for mounting said bracket at said tool body;

a first actuating means for said bracket, and said means being located on said rear extension to affect, in an initial stage of a crimping operation when said jaws are apart, said engagement edge so as to bring the bracket in a position where said abutment edge extends in front of a crimping die element in the second jaw occupied by a treated cable shoe, allowing only the contact part of this cable shoe to project beyond said edge;

a second actuating means for said bracket, and said means being located on the pair of pliers adjacently one of said two arm portions to affect, in a final stage of a crimping operation when said jaws are close together, the bracket so as to swivel in a position where said abutment edge completely clears a crimping die element in the second jaw occupied by a treated cable, thus allowing the affixing part of said cable shoe and an electrical conductor inserted therein to extend axially when being crimped;

an actuating spring to constantly press the bracket into engagement with at least one of said actuating means.

9. The device of claim 8, wherein said abutment edge presses a cable shoe which is inserted into a crimping die element in the first jaw against this element in advance of such an action exercised by the co-operating crimping die element in the second jaw upon approach.

10. The device of claim 8, wherein said mounting means is defined by said first pivot pin.

11. The device of claim 8, wherein said second pivot pin has a projecting portion and this projecting portion defines said first actuating means.

12. The device of claim 8, wherein said engagement edge has a stepped-off portion for engagement with said second actuating means.

13. The device of claim 8, wherein the second handle is attached to the tool body with the aid of a third pivot pin and a connecting link mounted on said pivot pin and pivotally attached to the tool body, and said third pivot pin has a projecting portion defining said second actuating means.

14. The device of claim 13, wherein said engagement edge has a stepped-off portion for engagement with said third pivot pin.

15. The device of claim 8, wherein said second actuating means is defined by a projection on the forward end of the first jaw.

16. The device of claim 8, comprising a spring having two arms projecting from a loop, one said arm being anchored in the tool body, the second arm being anchored in the bracket and the loop being mounted on the first pivot pin, said spring defining said actuating spring.

17. The device of claim 8, wherein said actuating spring is an extension spring operative between said second jaw and said bracket.

* * * * *